United States Patent [19]

Merkl

[11] 4,182,685

[45] Jan. 8, 1980

[54] METHOD OF PREPARING METAL-CONTAINING SOAP AND SOAP SO PRODUCED

[76] Inventor: George G. Merkl, 46 Sunset Ct., Haworth, N.J. 07651

[21] Appl. No.: 758,346

[22] Filed: Jan. 10, 1977

Related U.S. Application Data

[63] Continuation-in-part of Ser. No. 534,084, Dec. 23, 1974, abandoned.

[51] Int. Cl.[2] ..... C11D 9/38; C11D 13/00

[52] U.S. Cl. ..... 252/117; 252/132; 252/367; 252/368

[58] Field of Search ..... 252/117, 132, 108, 34, 252/35, 36, 367, 368

[56] References Cited

U.S. PATENT DOCUMENTS

| | | | |
|---|---|---|---|
| 3,507,791 | 4/1970 | Teeter et al. | 252/35 X |
| 4,029,747 | 6/1977 | Merkl | 423/351 X |

*Primary Examiner*—Harris A. Pitlick

*Attorney, Agent, or Firm*—Arnold, White & Durkee

[57] ABSTRACT

Metal-containing soaps are prepared by reaction of at least one fatty acid with a water-soluble, multi-metal, inorganic, amide group-containing monomeric or polymeric complex. Such monomeric or polymeric complex is obtained by reacting, in the presence of aqueous ammonia, at least one non-alkaline metal with an alkali metal hydroxide in accordance with a reaction sequence which produces reactive $NH_2$ groups. Variation of the reaction parameters, particularly pH, will determine whether the soap has detergent or non-detergent properties. To produce a detergent soap also containing effective bleach properties, hydrogen peroxide can be added to the fatty acid and complex reactants.

9 Claims, 6 Drawing Figures

METHOD OF PREPARING METAL-CONTAINING SOAP AND SOAP SO PRODUCED

RELATED APPLICATION

This application is a continuation-in-part of applicant's co-pending application Ser. No. 534,084, filed on Dec. 23, 1974, now abandoned and entitled "Soaps and Detergents".

SUMMARY OF THE INVENTION

The present invention is directed to the production of metal-containing soaps, specifically those obtained by reaction of a fatty acid with a multi-metal, water-soluble, inorganic amide group ($NH_2$)-containing monomeric or polymeric complex.

Co-pending application Ser. No. 631,949, filed on Nov. 17, 1975 now U.S. Pat. No. 4,029,747, discloses a method for producing certain novel inorganic monomeric and polymeric complexes and such complexes so produced. In accordance with the present invention, novel industrial and detergent soaps are prepared by reaction of either the monomeric or the polymeric complex of said co-pending application with at least one fatty acid. Where the soap is to have detergent properties, treatment of the monomeric complex with hydrogen perioxide prior to reaction with the fatty acid will provide additional bleach characteristics, while prior reaction with a modified starch will improve the sudsing characteristics and water retention of the soap.

It is theorized from analytical data that each monomeric unit of the complexes employed to produce the soap products of the present invention includes a plurality of reactive $NH_2$ groups, while the polymeric complexes contain a plurality of both NH and $NH_2$ groups. When such complexes are reacted with a fatty acid, the fatty acid units appear to replace these $NH_2$ and/or NH groups to produce a final soap product. As used throughout this disclosure, the term "fatty acid units" is intended to refer to that portion of the fatty acid molecule that replaces the $NH_2$ and/or NH groups of the monomeric and/or polymeric complex.

In preparing the soap products of the present invention, the reaction between the fatty acid and the multi-metal, water-soluble, inorganic amide group-containing monomeric or polymeric complex is preferably carried out by simply contacting the reactants while in liquid condition. For most fatty acids, this is achieved at temperatures below about 200° F. Where non-detergent, industrial soaps are to be produced, it is preferable to minimize the water content of the reaction system. To achieve this, more concentrated reactants and extra amounts of fatty acid are preferably utilized. A minimum amount of water will allow the formation of a solid particulate product. On the other hand, where detergent soaps are desired, it is typically preferred to use as much as 40% water or more.

Where detergent soaps having bleach characteristics are desired, hydrogen peroxide can be added to the reaction system. The hydrogen peroxide appears to replace the $NH_2$ groups of the complex with $HO_2$ groups, thereby liberating $NH_2$ groups which in turn react with the fatty acid to produce aminated fatty acid units. These units thereafter combine with the $HO_2$ groups to yield a final product with both fatty acid units and hydroperoxy groups. This product is an effective soap with oxygen bleach properties.

DESCRIPTION OF THE PREFERRED EMBODIMENTS

Figure 1:
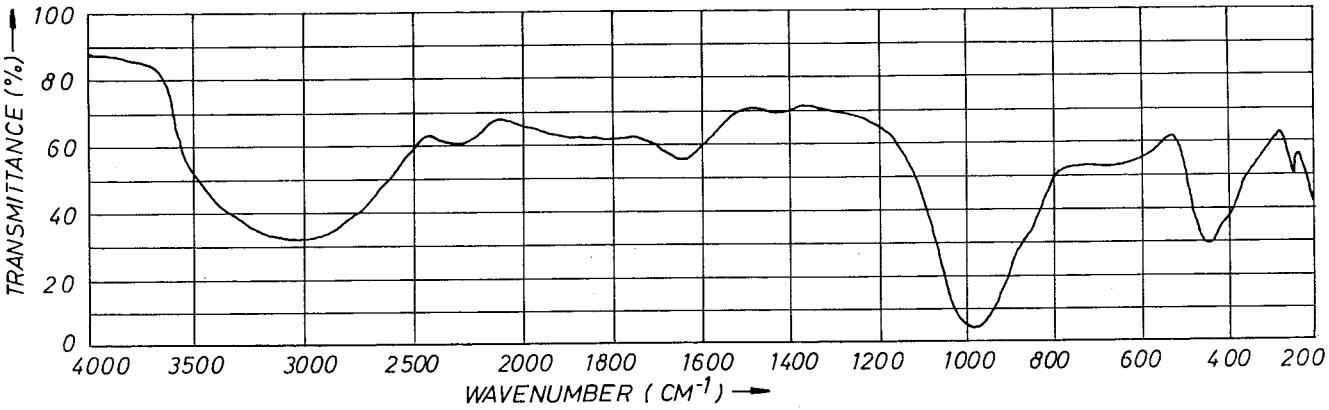
FIG. 1 is an infra-red scan of a monomeric complex reactant containing sodium and silicon.

The metal-containing soaps of the present invention are prepared by contacting and reacting at least one fatty acid compound (with or without added hydrogen perioxide) with a water-soluble, multi-metal, inorganic, amide group-containing monomeric and/or polymeric complex produced as hereinafter described. It is theorized in accordance with the present invention that the $NH_2$ and/or NH groups of the inorganic complex react with the fatty acid, replacing the $NH_2$ and/or NH groups with fatty acid units. In addition, when hydrogen peroxide is also present in the reaction system, there appears to be a replacement of $NH_2$ groups with hydroperoxy ($HO_2$) groups. The fatty acid is thereafter aminated with these liberated $NH_2$ groups to yield a final product containing both fatty acid units and $HO_2$ groups.

To prepare the metal-containing soaps of the present invention, the following reactants are required:

A. At least one water-soluble, multi-metal, inorganic, amide group-containing monomeric and/or polymeric complex;

B. At least one fatty acid containing material, and

C. Optionally, hydrogen peroxide; and

D. Optionally, a modified starch.

These reactants are individually discussed below.

A. The Monomeric and/or Polymeric Complex

A full description of the preparation of the monomeric and/or polymeric complex reactants utilized in the process of the present invention can be found in applicant's co-pending application Ser. No. 631,949, filed on Nov. 17, 1975, the disclosure of which is hereby incorporated by reference.

In general, these complex reactants are prepared in accordance with a reaction sequence which involves: introducing an excess of one or more non-alkaline metals into a reaction vessel, preferably already containing aqueous ammonia, and thereafter incrementally adding an alkali metal hydroxide in such manner as to create localized areas of high alkali concentration, the pH approaching a value of 14 in such localized areas. The hydroxide in these areas of high concentration, in combination with the reactive $NH_2$ groups provided by the aqueous ammonia, causes accelerated dissolution of the non-alkaline metal, and the formation of a multi-metal complex of non-alkaline and alkali metal ions, with attached $NH_2$ groups. Subsequently, this monomeric complex goes through an exothermic reaction, with the evolution of hydrogen, which appears to result in the formation of a polymeric complex. Accordingly, the reactants necessary to produce such monomeric and/or polymeric complex include at least one non-alkaline metal, a source of $NH_2$ groups, particularly aqueous ammonia, and an alkali metal hydroxide. These reactants will be individually discussed below.

The non-alkaline metal reactant may be one or more metals selected from those non-alkaline metals of Groups I–VIII of the Periodic Table. Representative, non-limiting examples of applicable non-alkaline metals include:

Group I-B copper, silver, gold
Group II-A beryllium, magnesium
Group II-B zinc, cadmium
Group III-A aluminum, gallium, indium
Group IV-A silicon, tin, lead
Group IV-B titanium, zirconium, hafnium
Group V-A antimony, bismuth
Group V-B vanadium, niobium, tantalum
Group VI-A chromium, molybdenum, tungsten
Group VI-B manganese
Group VIII iron, cobalt, nickel, palladium, rhodium It should be recognized that while silicon, as a member of Group IV-A, is not generally defined as a metallic element, silicon acts as a non-alkaline metal in preparing the monomeric complex reactant. Accordingly, the expression "non-alkaline metal of Groups I–VIII of the Periodic Table" is meant to embrace any and all of the above and equivalent metals, including silicon. As will be further recognized, the term "non-alkaline metal of Groups I–VIII of the Periodic Table" does not embrace the alkali metals of Group I-A. The alkaline earth metals, calcium, strontium and barium of Group II-A, are similarly not within the scope of the term. On the other hand, beryllium and magnesium of Group II-A can be applicably employed in the preparation of the complex reactants and these metals also fall within the scope of the expression "non-alkaline metal of Groups I–VIII of the Periodic Table". While any of the above non-alkaline metals can be utilized to form the monomeric and/or polymeric complex reactant which is contacted and reacted with a fatty acid to form the metal-containing soap in accordance with the present invention, the non-alkaline metal utilized is preferably one which contributes additional valuable properties to the soap, particularly those metals which have heretofore been used in preparation of industrial soaps, etc. Preferred examples of such metals include magnesium, aluminum, silicon, zinc, titanium, zirconium, molybdenum, and tungsten. While these metals are preferred and while the representative exemplification will be directed primarily thereto, it should be recognized from applicant's co-pending application Ser. No. 631,949 that the monomeric and/or polymeric complex reactant can be formed from any of the non-alkaline metals of Groups I–VIII of the Periodic Table, and accordingly, the metal-containing soap of the present invention can be effectively prepared from any such complexes.

An alkali metal hydroxide is utilized as the second reactant to produce the monomeric and/or polymeric complex reactant. This reactant can comprise any hydroxide of a metal of Group I-A of the Periodic Table, principally, sodium hydroxide, potassium hydroxide or lithium hydroxide. The alkali metal hydroxide can be employed either in solid form or in the form of a prepared aqueous solution of the alkali metal hydroxide. In solid form, the alkali metal hydroxide can be conveniently in the form of pellets, powder or flakes.

Analytical studies have shown that the inorganic monomeric complexes useful in accordance with the present invention contain $NH_2$ groups, with at least a portion of the $NH_2$ groups being converted to NH groups in formation of the polymeric complex. Accordingly, the third essential reactant in the method of producing the complexes useful in the present invention comprises any substance which, under the conditions of the reaction, acts as a source of $NH_2$ groups.

In the preferred reaction for preparation of the monomeric and/or polymeric complex reactant, the source of $NH_2$ groups comprises aqueous ammonia. $NH_2$ groups are liberated when this aqueous ammonia is brought into reactive contact with the alkali metal hydroxide and non-alkaline metal. As an alternative, ammonia gas may be used, introducing the gas into an aqueous reaction system by any suitable conventional techniques, such as bubbling. The use of ammonia gas in this manner also permits a supplementing of the supply of the $NH_2$ source at any stage during the reaction.

Another applicable alternative $NH_2$ source may be formed directly in the reaction medium by utilizing as a reactant an $NO_x$ gas, i.e., NO and/or $NO_2$, or nitric acid. The use of $NO_x$ gas or nitric acid as a source of reactive $NH_2$ groups appears applicable as a result of the production of hydrogen ions during the dissolution of the non-alkaline metal upon addition of the alkali metal hydroxide. These hydrogen ions react with the $NO_x$ groups in the reaction medium, creating in situ the reactive $NH_2$ groups. These reactive $NH_2$ groups are then available for metal amide formation and formation of the inorganic monomeric and/or polymeric complex reactant. When the non-alkaline metal is not easily dissolved in the reaction medium upon alkali metal hydroxide addition, it may be necessary to assist the dissolution so as to develop the hydrogen ions necessary for reactive $NH_2$ groups production.

As disclosed in applicant's co-pending application Ser. No. 631,949, filed Nov. 17, 1975, the reaction between the non-alkaline metal, alkali metal hydroxide and source of $NH_2$ groups proceeds through a first endothermic phase wherein a monomeric complex is produced, and thereafter, through an exothermic phase wherein the monomeric complex polymerizes into a polymeric complex form. From analytical data which has thus far been obtained, it is postulated that, during this polymerization stage, a substantial portion of the $NH_2$ groups of the inorganic monomeric complex are broken up into NH and hydride groups which are present in the polymerized complex.

In preparing the soaps of the present invention, either the monomeric complex or the polymeric complex reactant can be used. In actual fact the complex reactant is typically a mixture of both monomeric and polymeric products, since this is what often results, depending on the circumstances surrounding termination of the polymerization reaction. When hydrogen peroxide is used as a supplemental reactant to produce a detergent soap with oxygen bleach properties, it is preferred to utilize a monomeric complex reactant, or at least one that results from terminating the complex formation reaction prior to completion of the exothermic polymerization phase. This is because the hydrogen peroxide does not easily break the NH bonds of the polymeric complex, yet easily reacts with or replaces the $NH_2$ group of the monomeric complex.

In actual fact, it appears unlikely that the complex product of the endothermic phase of reaction is totally monomeric, or that of the exothermic phase of reaction is totally polymeric. Rather, while one state will clearly predominate in each phase, it is probable that both monomers and polymers will co-exist in the complex products.

Accordingly, the expression "water-soluble multimetal inorganic amide group-containing monomeric and/or polymeric complex" as used throughout is meant to embrace the product of either or both the endothermic and exothermic phases of the above-discussed reaction.

The amount of alkali metal present in the complex reactant will have some bearing on the properties of the final soap product. For example, as will be well understood, the lower the alkali metal content of the final product, the less water-soluble it will be. Therefore, when insoluble, industrial type soap is desired, it is preferable to employ an inorganic polymeric complex reactant or a monomeric complex reactant of reduced alkali metal content. The selection of a particular complex reactant with the desired alkali metal content for the desired degree of solubility of the final soap product can be easily carried out by one of ordinary skill in the art through routine experimentation.

Throughout the foregoing and following description, reference has been made to the production of an inorganic monomeric "complex". The term "complex" is used because the structural configurations of these products have not been precisely determined. However, extensive analysis has been conducted which has established the monomeric and polymeric nature of the products and the presence of certain functional groups. In view of the difficulty in precisely determining the structural configuration of products obtained through complex chemical reactions, the expression "complex" is deemed aptly descriptive of this reactant used in the method of the present invention.

B. The Fatty Acid

The second essential component in preparing the metal-containing soaps of the present invention is a material containing a fatty acid. Such fatty acids can be those which are conventionally employed in soap manufacture, typically those which contain from about 12 to about 20 carbon atoms. Representative examples include lauric acid, myristic acid, palmitic acid, stearic acid, oleic acid, linoleic acid, linolenic acid, and the like. Such fatty acids, which may be employed singly or in combination in preparation of the metal-containing soaps of the present invention, can be either saturated or unsaturated fatty acids. In addition, while the fatty acid or acids employed in the method of the present invention are typically mono-functional fatty acids, polyfunctional fatty acids can also be advantageously employed.

Mixtures of saturated fatty acids and/or unsaturated fatty acids, as found in typical fat or oil compositions generally used in the preparation of soaps, are very effectively utilized in the method of the present invention. Exemplary fats and oils include beef tallow, butter, coconut oil, corn oil, cotton seed oil, lard, palm oil, palm kernel, peanut oil, soy bean oil, cod liver oil, lindseed oil, and tung oil. Thus, the method of the present invention can take advantage of commercially available mixtures of fatty acids, such as that comprising 80% tallow fatty acid and 20% coco fatty acid. It should be appreciated that the nature of the fatty acid employed in the method of the present invention as well as the possible combinations of such fatty acids is virtually unlimited.

C. Optional Hydrogen Peroxide

Where a soap product is desired which has detergent characteristics, it is often desirable to provide bleach characteristics as well, and to this end, hydrogen peroxide can be introduced into the reaction system as an optional reactant.

As indicated previously, the hydrogen peroxide appears to react with the monomeric complex, replacing the amide groups with hydroperoxy groups. It is theorized that the subsequently added fatty acid then reacts with the liberated $NH_2$ groups to produce an aminated fatty acid unit that thereafter combines with the hydroperoxy groups to form a final product containing both fatty acid units and hydroperoxy groups. It is these hydroperoxy groups which provide the oxygen bleaching characteristics to the final product.

D. Optional Modified Starch

The process of the present invention also contemplates the incorporation of a modified starch into the final composition, not only as a filler, but also to improve the water holding and sudsing characteristics of the detergent soaps produced according to the present invention. The modified starches applicable in accordance with the present invention are starches which have been modified by attachment thereto of monomeric or polymeric units of the same inorganic monomeric and/or polymeric complexes as described above. Generally, the modified starch is prepared by contacting any commercially available starch, such as a potato starch, corn starch, wheat starch, rice starch, and the like, with an aqueous solution of the inorganic monomeric or polymeric complex. This effects a chemical reaction between the starch and inorganic monomeric and/or polymeric complex, greatly altering the properties of the original starch material. This modified starch is then effectively employed in the method of the present invention. In preparing the modified starch, the same inorganic monomeric or polymeric complex as utilized to prepare the soap can be effectively used. The preparation of this modified starch is fully described in co-pending application Ser. No. 758,318, filed Jan. 10, 1977, which application is now abandoned.

Reaction Parameters

In accordance with the present invention, it is merely necessary to provide sufficient contact between the fatty acid and the monomeric and/or polymeric complex such that the fatty acid units of the fatty acid chemically combine with the $NH_2$ and/or NH groups of the inorganic monomeric and/or polymeric complex to produce a final soap product containing fatty residues. This can be effectively accomplished simply by mixing a suitably prepared fatty acid-containing material with an aqueous solution of the inorganic monomeric and/or polymeric complex, typically at temperatures above about 105° F. and preferably up to between about 160°-180° F. Such soap product forms in the reaction system during the mixing of the reactants.

The pH of the reactant solution will, it is theorized, determine the chemical structure of the final product. With a pH of equal to or greater than 11.0, the fatty acid units appear to attach to the alkali metal of the monomeric and/or polymeric complex and a soap having detergent properties is produced. On the other hand, when the pH of the reactant solution is acidic or slightly basic, the fatty acid units appear to attach to the non-alkaline metal portion of the monomeric and/or polymeric complex and the soap is insoluble and does not have detergent properties. Thus, by controlling the pH of the reaction, one skilled in the art will be able to direct the production of either detergent soaps or non-detergent soaps useful for industrial purposes.

The optional use of hydrogen peroxide in the reaction has previously been mentioned as of value in producing a detergent soap which additionally has bleach characteristics associated with hydroperoxy groups introduced by the hydrogen peroxide. It will be apparent, therefore, that when hydrogen peroxide is used, the pH of the reactant solution should be equal to or greater than 11.0. Those skilled in the art will also appreciate that the use of hydrogen peroxide will require reaction temperatures as low as conveniently feasible and that since the hydrogen peroxide is utilized generally as an aqueous solution, some measure of control over the final water content of the detergent soap is also possible.

In some situations, particularly when non-detergent, industrial soaps are contemplated, it may be desirable to produce the soap in the form of a dry, or substantially dry powder. In such cases, the water content of the inorganic monomeric and/or polymeric complex solution can be reduced prior to reaction by evaporating some of the water present. Preferably, after the preparation of such complex, but before addition of the fatty acid, the aqueous solution of the inorganic monomeric or polymeric complex is heated to evaporate about one-half of its water content. This concentrated solution is then very effective for producing the metal-containing soap in the form of a substantially dry powder.

The selection of an appropriate water content for a particular system can be easily carried out by one skilled in the art through routine experimentation. The selection of a water content appropriate to achieve a substantially dry product when hydrogen peroxide solution is reacted with the inorganic monomeric and/or polymeric complex is likewise within the skill of the art. Moreover, precise selection of the water content is not necessary since any wet product formed may be conveniently dried by vacuum evaporation with or without gentle heating of the wet solid.

When carrying out the reaction of the present invention, it will generally be preferred to utilize the inorganic monomeric complex. As indicated previously, it is theorized that the inorganic monomeric complex will contain a number of $NH_2$ groups generally corresponding to the combined valence of the alkali metal and non-alkaline metal. Generally, the inorganic monomeric complex will contain three, four or five such $NH_2$ groups. In the formation of the inorganic polymeric complex, some of these groups are converted to NH units and some are even further reduced to produce N-N bonding. In the reaction of the present invention, the fatty acid units and/or hydrogen peroxide replaces or chemically combines with one or more of such $NH_2$ or NH groups in order to produce the final soap product. The degree of replacement and/or chemical combination will depend upon the molar ratio of the inorganic monomeric and/or polymeric complex to the fatty acid or fatty acid and hydrogen peroxide. The molar ratio of fatty acid to inorganic monomeric or polymeric complex can suitably vary from 1:1 or below to 5:1 or more. Again, the particular molar ratio of the fatty acid to such inorganic complex can be easily selected by one skilled in the art, depending upon the desired properties of the final metal-containing soap.

When hydrogen peroxide is employed as a further reactant, the amount of hydrogen peroxide taken up into the final detergent soap product will generally vary from about 2% to about 30% by weight, based on the weight of the fatty acid reactant. This, of course, assumes that an excess of available hydrogen peroxide is used in the reaction and that all available $NH_2$ and/or NH groups react with the hydrogen peroxide to produce a "hydroperoxy saturated" soap. Lesser amounts of hydrogen peroxide may be used, as may be desired, to "tailor" the bleach characteristics of the final detergent soap product.

The preparation of the metal-containing soaps of the present invention is basically achieved by merely contacting, through mixing, the above-described reactants in a suitable vessel. Ambient temperature and pressure conditions may be employed, but it is preferred to carry out the reaction at temperatures above about 105° F., at which the fatty acids to be reacted are more readily miscible in the aqueous reaction medium. Ideally, temperatures in the range of 160°-180° F. are utilized, with the high temperature limited only by the boiling point of the reaction medium at the pressure conditions of the reaction, and the lower temperature being primarily governed by the miscibility characteristics of the fatty acid.

When a modified starch is added, it can be added directly to the reaction vessel during the soap preparation reaction or subsequently, by mixing to the prepared soap. This modified starch filler is generally added in an amount of from about 10% to about 50% by weight, based on the weight of the final soap product, although lesser or greater amounts can be added where desired for particular purposes.

The present invention will now be described by reference to the following specific examples. Such examples are presented for purposes of illustration only and the present invention cannot under any circumstances be deemed limited thereto. In these following examples, unless otherwise stated, all parts and precentages are by weight.

EXAMPLE 1

A silicon-sodium monomeric complex is prepared following the reaction sequence and parameters described in co-pending application Ser. No. 631,949, filed on Nov. 17, 1975. The reactants include 616 g of silicon metal, 1,925 g of aqueous ammonia (28° Be) and 440 g of sodium hydroxide, the latter being metered slowly into the reaction system in order to develop an endothermic phase of reaction. After completion of the reaction, the silicon remaining is removed from the reaction system and found to weigh 320 g. Accordingly, some 296 g of silicon enter into the inorganic monomeric complex. Due to the high viscosity of this complex the complex is diluted with 500 ml of deionized water. The aqueous solution of the monomeric complex has a specific gravity of 1.461.

To prepare the silicon containing soap in accordance with the present invention, some 12 g of this aqueous solution of the silicon monomeric complex are mixed with 13.7 g of tallow fatty acid under ambient temperature and pressure conditions. This mixing results in the formation of an off-white, substantially dry powder.

Figure 2:
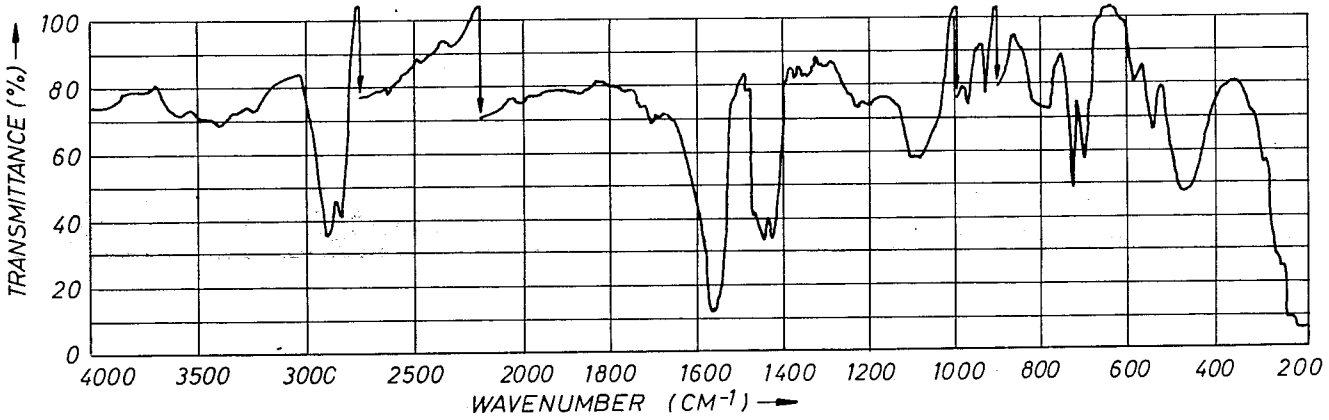
FIG. 2 is an infra-red scan of a metal-containing soap product in accordance with the present invention, formed by reacting the silicon-sodium monomeric complex of FIG. 1 with tallow fatty acids.

FIG. 1 represents an infra-red scan of the silicon-sodium monomeric complex produced as described above, while FIG. 2 represents an infra-red scan of the above prepared soap. By comparing FIG. 1 with FIG. 2, the introduction of the organic fatty residues into the soap product can be seen.

EXAMPLE 2

Following the procedure of Example 1, a similar silicon-sodium monomeric complex is prepared. This complex is further reacted with potato starch to produce a modified starch following the procedure as fully described in copending application Ser. No. 758,318.

To prepare the silicon-containing modified starch soap in accordance with the present invention, some twelve grams of the silicon monomeric complex are mixed with 13.7 grams of tallow fatty acid and 14.0 grams of the modified starch.

Figure 3:
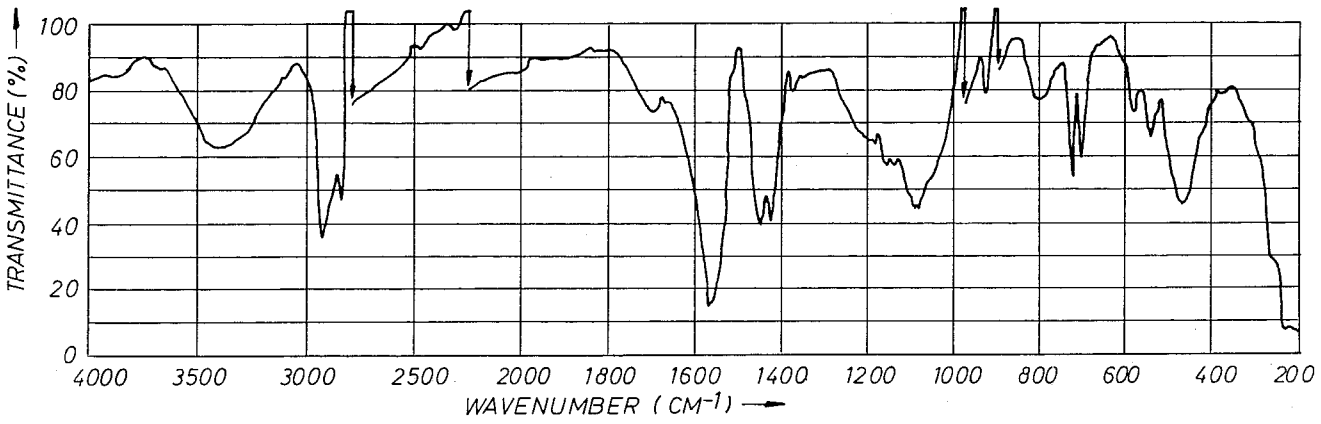
FIG. 3 is an infra-red scan of a silicon-containing modified starch soap product in accordance with the present invention, formed by reacting the silicon-sodium monomeric complex of FIG. 1 with tallow fatty acids and silicon-complex modified starch.

FIG. 3 represents an infra-red scan of the above-prepared soap. By comparing FIG. 3 with FIG. 2, it can be seen that there is a decrease in the concentration of the organic fatty acid, indicating that the modified starch has been introduced into the soap product.

EXAMPLE 3

Following the procedure of Example 1, a soap-containing molybdenum metal is prepared.

First, a molybdenum-sodium monomeric complex is prepared by reacting molybdenum metal (4,538.8 g) in aqueous ammonia, (1,930.6 g—28° Be) with the controlled incremental addition of 630.4 g of sodium hydroxide. After the addition of the sodium hydroxide, the reaction system is heated slightly to 85°-100° C., utilizing a dry ice condenser to prevent ammonia escape. Due to the slow reaction of molybdenum, this slight heating is necessary in order to initiate the dissolution of the molybdenum in the reaction system. The reaction is run in this manner for several days after which a low heat of approximately 30° C. is applied. The reaction is thereafter run for approximately one week without any heat in order to prepare the final molybdenum-sodium monomeric complex. The final product has a specific gravity of 1.332.

To prepare the molybdenum-containing soap, 12 g of the above monomeric complex are reacted with 5 ml of hydrogen peroxide and 13.7 grams of tallow fatty acid. This reaction is extremely exothermic. The reaction occurs merely by mixing the monomeric complex, hydrogen peroxide and fatty acid.

EXAMPLE 4

In this example, a molybdenum-containing modified starch soap is prepared by a procedure substantially as described in connection with Example 2.

To prepare the molybdenum-containing modified starch soap, 12.0 grams of the same molybdenum monomeric complex as described in Example 3 are reacted with a mixture of 13.7 g of tallow fatty acid and 14.0 grams of a Mo-complex modified starch.

EXAMPLE 5

In this example an aluminum-containing soap is prepared by following the procedure, substantially as described in connection with Example 1.

To prepare the aluminum-containing monomeric complex, 713 g of aluminum are introduced into 1,820 g of aqueous ammonia (28° Be) and thereafter 520 g of sodium hydroxide pellets are incrementally introduced into the reaction system over a period of about two hours. The reaction system develops a natural endothermic phase and thereafter begins to enter an exothermic phase. The reaction is terminated by withdrawing unreacted aluminum when the temperature of the reaction system reaches 150° F. Some 647 g of aluminum are removed from the reaction system, indicating that 66 g of aluminum are introduced into the monomeric complex. The monomeric complex obtained has a specific gravity of 1.314.

To prepare the aluminum-containing soap, 12 g of the above-prepared monomeric complex are reacted with 8.33 ml hydrogen peroxide and 13.7 g of tallow fatty acid, the components being mixed thoroughly until the soap crystallizes as a substantially dry powder. The formation of the soap by mixing the aluminum-containing monomeric complex, fatty acid and hydrogen peroxide is exothermic.

EXAMPLE 6

Following the procedure generally described in Example 2 above, an aluminum-containing modified starch soap is prepared by reacting 12.0 grams of the same aluminum monomeric complex as prepared in Example 5 with a mixture of 13.7 grams of tallow fatty acid and 14.0 grams of A1-complex modified starch. To the resulting product 2.0 grams of hydrogen peroxide are added.

EXAMPLE 7

Following the procedure of Example 1, a zirconium-containing soap is prepared from a zirconium-sodium inorganic monomeric complex. This complex is prepared through a reaction which involves introducing 2,241.6 g of zirconium metal into 1,078 g of aqueous ammonia (28° Be) and thereafter incrementally introducing 246.4 g of sodium hydroxide pellets. The feed of sodium hydroxide is accomplished in approximately one hour and forty minutes, and thereafter, the reactants are maintained undisturbed, while entering an endothermic phase of reaction. The reaction is terminated by removing unreacted zirconium metal, the monomeric complex having a specific gravity of 1.227.

To prepare the soap product, 12 g of this zirconium-containing monomeric complex are mixed with 10 ml of hydrogen peroxide (50%) and 13.7 g of tallow fatty acid, the mixing being carried out thoroughly until crystallization of the soap occurs. This mixing results in a slightly exothermic reaction.

EXAMPLE 8

Following the procedure generally described in Example 2 above, a zirconium-containing modified starch soap is prepared by reacting 12.0 grams of the same zirconium monomeric complex as prepared in Example 7 with a mixture of 13.7 g of tallow fatty acid and 14.0 g of Zr-complex modified starch. To the resulting product 2.0 g of hydrogen peroxide are added. The specific gravity of the soap product is 1.227.

EXAMPLE 9

Following the procedure of Example 1, a titanium-sodium monomeric complex is prepared and is subsequently utilized to prepare a titanium-containing soap. The titanium monomer is prepared by reacting 1,997.52 g of titanium metal in 2,080.75 g of aqueous ammonia (28° Be) with 951.2 g of sodium hydroxide pellets, introduced incrementally. The sodium hydroxide is fed over a time period of approximately 40 minutes after which the reactants are allowed to remain undisturbed in the reaction vessel. The reaction is terminated by withdrawing unreacted titanium from the reaction system, yielding a monomeric complex having a specific gravity of 1.432.

This monomeric complex is reacted with hydrogen peroxide by mixing 12 g of a monomeric complex with 5 ml of a 50% hydrogen peroxide solution and 13.7 g of tallow fatty acid. The components are mixed thoroughly until the soap product crystallizes as a substantially dry powder.

EXAMPLE 10

In this example, a titanium-containing modified starch soap is prepared by a procedure substantially as described in connection with Example 2.

To prepare the titanium-containing modified starch soap, 12.0 grams of the titanium monomeric complex are reacted with a mixture of 13.7 grams of tallow fatty acid and 14.0 grams of Ti-complex modified starch. The modified starch soap product has a specific gravity of 1.432.

EXAMPLE 11

Following a procedure similar to that of Example 1, a tungsten-sodium monomeric complex is produced by reacting 603.5 g of tungsten in 245 g of aqueous ammonia (28° Be) through the incremental addition of 40 g of sodium hydroxide pellets. The sodium hydroxide pellets are introduced over a time period of approximately one and one-half hours. After introduction of the sodium hydroxide, the reaction is pushed by utilizing a 1.5 amp current in order to accelerate the dissolution of the tungsten metal.

After allowing the reaction to remain in this manner for a period of time, the reaction is terminated by withdrawal of unreacted tungsten, the monomeric complex having a density of 1.230. A soap product containing tungsten is prepared by reacting 12 g of this monomeric complex with 2 g of hydrogen peroxide (50%) and 13.7 g of tallow fatty acid.

EXAMPLE 12

To prepare a tungsten-containing modified starch soap in accordance with the present invention, some twelve grams of the tungsten monomeric complex of FIG. 11 are mixed with 13.7 grams of tallow fatty acid and 14.0 grams of W-complex modified starch. The modified starch soap product has a specific gravity of 1.230.

EXAMPLE 13

Utilizing a similar procedure as that described above in Example 1, a magnesium-containing soap is prepared from a magnesium-sodium monomeric complex. The complex is prepared by reacting 432 g of magnesium metal in 630 g of aqueous ammonia (28° Be) through the incremental addition of 240 g of sodium hydroxide pellets. The feed of sodium hydroxide is over a period of approximately one hour and fifty minutes. The reactants are allowed to remain undisturbed for a period of time. The reaction is terminated with withdrawal of unreacted magnesium, leaving a monomeric complex having a specific gravity of 1.264.

To prepare the magnesium-containing soap, 12 g of this magnesium-containing monomeric complex are reacted with 8 ml of hydrogen peroxide (50%) and 13.7 g of tallow fatty acid by thoroughly mixing the reactants until the magnesium-containing soap crystallizes. The reaction is exothermic.

EXAMPLE 14

To produce a zinc-sodium-containing monomeric complex in accordance with the above procedure, 2,080 g of powdered zinc metal are reacted with 840 g of aqueous ammonia (28° Be) through the incremental addition of 320 g of sodium hydroxide pellets. The sodium hydroxide pellets are fed into the reaction system over a period of approximately two hours and ten minutes. The reactants are allowed to remain undisturbed for a period of time. The reaction is terminated by withdrawing the unreacted zinc metal. The monomeric complex has a specific gravity of 1.277.

To prepare the zinc-containing soap, 12 g of the above monomeric complex are reacted with 4.5 ml of hydrogen peroxide (50%) and 13.7 g of tallow fatty acid by thoroughly mixing the reactants until the soap crystallizes as a substantially dry solid. This reaction is exothermic.

EXAMPLE 15

Following the procedure generally described in Example 2 above, a zinc-containing modified starch soap is prepared by reacting 12.0 grams of the zinc monomeric complex with a mixture of 13.7 grams of tallow fatty acid and 14.0 grams of Zn-complex modified starch. The specific gravity of the soap product is 1.277. To this resulting product 2.0 grams of hydrogen peroxide are added.

EXAMPLE 16

A silicon-sodium polymeric complex is prepared following the reaction sequence and parameters described in copending application Ser. No. 631,949, filed on Nov. 17, 1975. The reactants include 616 g silicon metal, 2054.8 g aqueous ammonia (28° Be) and 616 g sodium hydroxide, the latter being metered slowly into the reaction system in order to develop an endothermic phase of reaction. After completion of the reaction, the unreacted silicon is removed from the reaction system. The polymeric complex is diluted with 500 ml of deionized water.

To prepare the silicon containing soap in accordance with the present invention, some 12 g of this aqueous solution of the silicon polymeric complex are mixed with 13.7 g of tallow fatty acid under ambient temperature and pressure conditions. This mixing results in the formation of an off-white, substantially dry powder.

Figure 4:
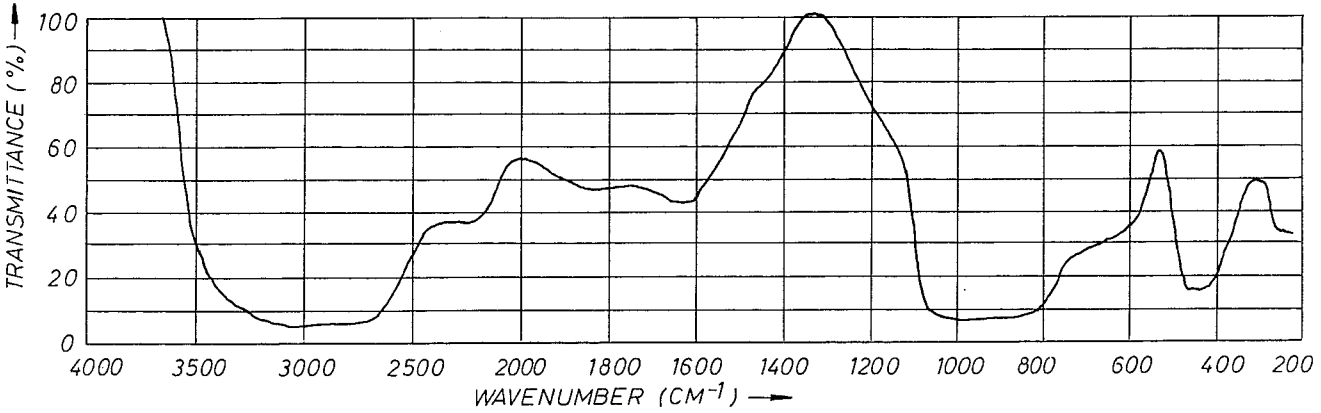
FIG. 4 is an infra-red scan of a polymeric complex reactant containing silicon and sodium.
Figure 5:
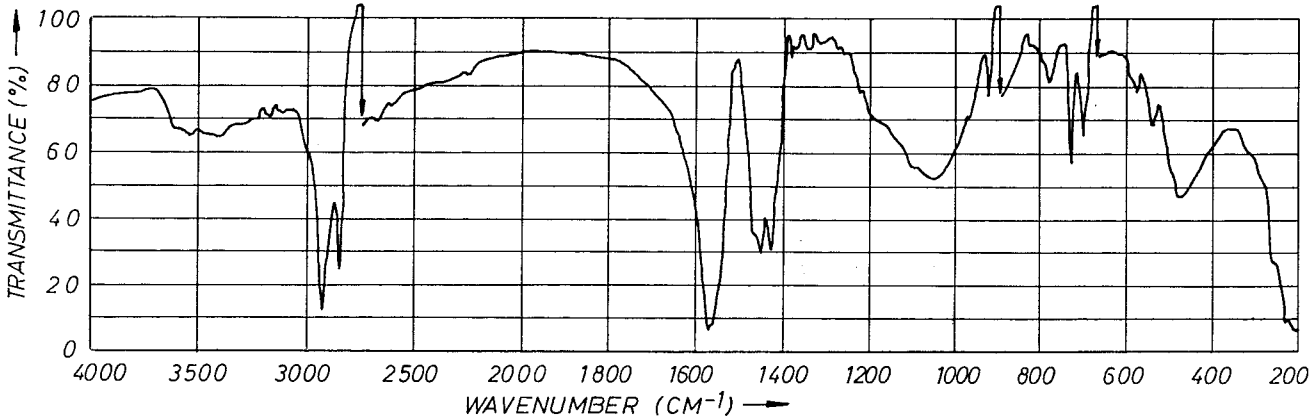
FIG. 5 is an infra-red scan of a silicon-containing soap product in accordance with the present invention formed by reacting the silicon-sodium polymeric complex of FIG. 4 with tallow fatty acids.

FIG. 4 represents an infra-red scan of the silicon-sodium polymeric complex produced as described above, while FIG. 5 represents an infra-red scan of the above prepared soap. By comparing FIG. 4 with FIG. 5 the introduction of the organic fatty residues into the soap product can be seen.

EXAMPLE 17

Following the procedure of Example 16, a silicon-sodium polymeric complex is prepared. 7.5 g of this complex are further reacted with 50 g potato starch and 10 g of hydrogen peroxide to produce a Si-complex modified starch following the procedure as fully described in co-pending application Ser. No. 758,318.

To prepare a silicon-containing modified starch soap in accordance with the present invention, some twelve grams of the silicon polymeric complex are mixed with 13.7 grams of tallow fatty acid and 14.0 g of the Si-complex modified starch.

Figure 6:
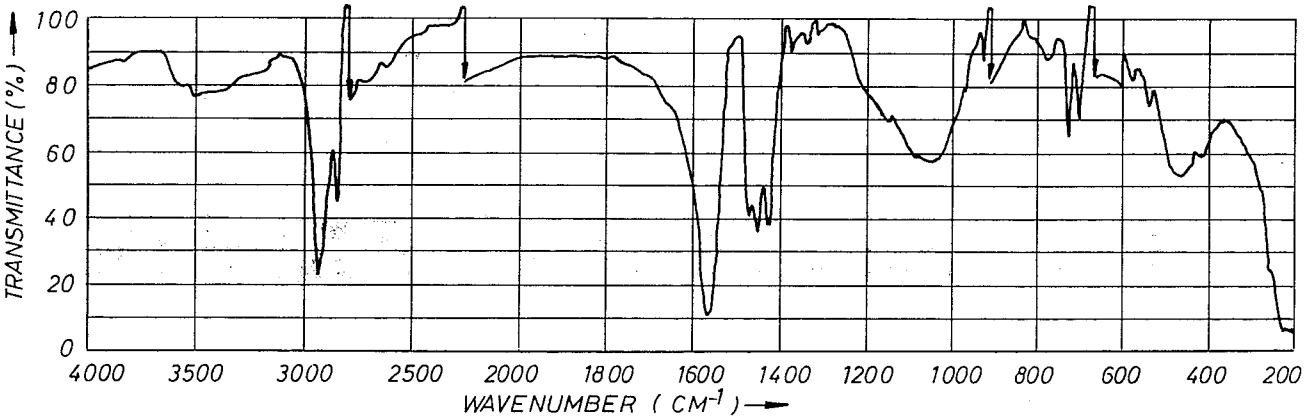
FIG. 6 is an infra-red scan of a silicon-containing modified starch soap product in accordance with the present invention formed by reacting the silicon-sodium polymeric complex of FIG. 4 with tallow fatty acids and the silicon-complex modified starch.

FIG. 6 represents an infra-red scan of the soap prepared in this Example. By comparing FIG. 5 with FIG. 6, it can be seen that there is a decrease in the concentration of the organic fatty acid, indicating that the modified starch has been introduced into the soap product.

EXAMPLE 18

Following the procedure of Example 16, a soap containing molybdenum metal is prepared.

Utilizing the same procedure as above in Example 16, a molybdenum-sodium inorganic polymeric complex is prepared by reacting 40 grams of sodium hydroxide with 384 grams of molybdenum metal in a reaction medium comprising 245 grams of aqueous ammonia (28° Be), the addition of the sodium hydroxide being such as to develop an endothermic phase of the reaction and thereafter, an exothermic phase of reaction. The initial molar ratio of molybdenum to sodium is 4:1.

The inorganic polymeric complex resulting from the exothermic reaction is analyzed to determine the molybdenum and sodium content. The molybdenum is precipitated by benzo-oxime and analyzed. The sodium is determined by direct atomic absorption. As a result, it is found that the inorganic polymeric complex contains 1.06% molybdenum and 8.10% sodium.

To prepare the molybdenum-containing soap, 12 g of the above polymeric complex are reacted with 2 g of hydrogen peroxide and 13.7 g of tallow fatty acid. This reaction is extremely exothermic, occurring merely by mixing the reactants.

EXAMPLE 19

In this example, a molybdenum-containing modified starch soap is prepared by a procedure substantially as described in connection with Example 17.

To prepare the molybdenum-containing modified starch soap, 12.0 grams of the molybdenum polymeric complex are reacted with a mixture of 13.7 grams of tallow fatty acid and 14.0 grams of Mo-complex modified starch. The resulting soap product has a specific gravity of 1.332.

EXAMPLE 20

An aluminum-sodium inorganic polymeric complex is prepared utilizing a procedure the same as that discussed above with respect to Example 16. In this example, 520 grams of sodium hydroxide are reacted with 702 grams of aluminum metal in 1,820 grams of aqueous ammonia (28° Be). Again, the addition of the sodium hydroxide is such as to first develop an endothermic phase of reaction and thereafter, an exothermic phase. The initial molar ratio of aluminum to sodium in the reactants is 2:1.

The inorganic polymeric complex resulting from the exothermic phase of the reaction is analyzed. The aluminum content of the complex is determined by hydroxide separation and ignition as aluminum oxide. The sodium content is determined by atomic absorption. An aluminum content of 18.31% is found and a sodium content of 11.25% is found.

To prepare the aluminum-containing soap, 12 g of the above-prepared polymeric complex are reacted with 2.0 g hydrogen peroxide and 13.7 g of tallow fatty acid, the components being mixed thoroughly until the soap crystallizes as a substantially dry powder. The formation of the soap by mixing the aluminum-containing polymeric complex, hydrogen peroxide and the fatty acid is exothermic.

EXAMPLE 21

Following the procedure generally described in Example 17 above, an aluminum-containing modified starch soap is prepared by reacting 12.0 grams of the aluminum polymeric complex with a mixture of 13.7 grams of tallow fatty acid and 14.0 grams of Al-complex modified starch. To the resulting product 2.0 grams of hydrogen peroxide are added. The specific gravity of the soap is 1.314.

EXAMPLE 22

Following the procedure of Example 16, an inorganic polymeric complex of zirconium and sodium is prepared. The reactants are: zirconium metal, 2,184 grams; sodium hydroxide, 120 grams; aqueous ammonia, 525 grams (28° Be). The initial molar ratio of zirconium to sodium is 8:1. The inorganic polymeric complex resulting from the exothermic phase of the reaction is analyzed. The zirconium is precipitated as zirconium oxide in cupferron and the sodium content is determined by atomic absorption. This analysis yields 2.73% zirconium and 8.46% sodium.

To prepare the soap product, 12 g of this zirconium-containing polymeric complex are mixed with 2 g of hydrogen peroxide (50%) and 13.7 g of tallow fatty acid, the mixing being carried out thoroughly until crystallization of the soap occurs. This mixing results in a slightly exothermic reaction.

EXAMPLE 23

To prepare the zirconium-containing modified starch soap in accordance with the present invention, some twelve grams of the zirconium polymeric complex are mixed with 13.7 grams of tallow fatty acid and 14.0 grams of the Zr-complex modified starch. Specific gravity of the soap is 1.227.

EXAMPLE 24

Following the same procedure as above, a titanium-sodium inorganic polymeric complex is obtained by reacting the following: 1,968 grams of titanium metal, 328 grams of sodium hydroxide, and 1,435 grams of aqueous ammonia (28° Be). The initial molar ratio of titanium to sodium is about 5:1. Again, the introduction of the sodium hydroxide into the reaction medium containing the titanium metal and aqueous ammonia is such as to produce an initial endothermic phase of reaction and subsequently, an exothermic phase of reaction.

The inorganic polymeric complex resulting from the exothermic phase of the reaction is analyzed and found to contain 11.54% sodium and 2.81% titanium. The titanium analysis is carried out by precipitation of titanium dioxide by cupferron. The sodium analysis is carried out by atomic absorption.

Twelve grams of this polymeric complex are reacted with 2 g of hydrogen peroxide (50%) and 13.7 g of tallow fatty acid. The components are mixed thoroughly until the soap product crystallizes as a substantially dry powder. The reaction is mildly exothermic.

EXAMPLE 25

In this example, a titanium-containing modified starch soap is prepared by a procedure substantially as described in connection with Example 17.

To prepare the titanium-containing modified starch soap, 12.0 grams of the titanium polymeric complex are reacted with a mixture of 13.7 grams of tallow fatty acid and 14.0 grams of Ti-complex modified starch. The specific gravity of the product is 1.432.

EXAMPLE 26

Following a procedure similar to that of Example 16, a tungsten-sodium polymeric complex is produced by reacting 603.5 g of tungsten in 245 g of aqueous ammonia (28° Be) through the incremental addition of 40 g of sodium hydroxide pellets. The sodium hydroxide pellets are introduced over a time period of approximately one and one-half hours. After introduction of the sodium hydroxide, the reaction is pushed by utilizing a 1.5 amp current in order to accelerate the dissolution of the tungsten metal.

After allowing the reaction to remain in this manner for a period of time, the reaction is terminated by withdrawal of unreacted tungsten. A soap product containing tungsten is prepared by reacting 12 g of this polymeric complex with 13.7 g of tallow fatty acid.

EXAMPLE 27

Following the procedure generally described in Example 17 above, a tungsten-containing modified starch soap is prepared by reacting 12.0 grams of the tungsten polymeric complex with a mixture of 13.7 grams of tallow fatty acid and 14.0 grams of W-complex modified starch. To the resulting product 2.0 grams of hydrogen peroxide are added. A specific gravity of 1.230 is measured.

EXAMPLE 28

A manganese-sodium polymer is prepared in a manner similar to the above, utilizing 3,135 grams of manganese, 285 grams of sodium hydroxide, and 1,995 grams of aqueous ammonia (28° Be), the molar ratio of manganese to sodium in the reaction being 8:1. A similar endothermic phase and exothermic phase are developed.

The product resulting from the exothermic phase of the reaction, i.e., the inorganic polymeric complex, is analyzed to determine the manganese and sodium content. A manganese content of 1.79% and a sodium content of 11.05% are found. The manganese content is determined by direct titration and the sodium content is determined by atomic absorption.

To prepare the magnesium-containing soap, 12 g of this magnesium-containing polymeric complex was reacted with 13.7 g of tallow fatty acid by thoroughly mixing the reactants until the magnesium-containing soap crystallizes. The reaction is exothermic.

EXAMPLE 29

To prepare the magnesium-containing modified starch soap in accordance with the present invention, some twelve grams of the magnesium polymeric complex are mixed with 13.7 grams of tallow fatty acid and 14.0 grams of the Mg-complex modified starch. The resultant product has a specific gravity of 1.264.

EXAMPLE 30

To produce a zinc-sodium-containing polymer in accordance with the above procedure, 2,080 g of powdered zinc metal are reacted with 840 g of aqueous ammonia (28° Be) through the incremental addition of 320 g of sodium hydroxide pellets. The sodium hydroxide pellets are fed into the reaction system over a period of approximately two hours and ten minutes. The reactants are allowed to remain undisturbed for a period of time.

To prepare the zinc-containing soap, 12 g of the above polymeric complex are reacted with 13.7 g of tallow fatty acid by thoroughly mixing the reactants until the soap crystallizes as a substantially dry solid. This reaction is exothermic.

EXAMPLE 31

Following the procedure generally described in Example 17 above, a zinc-containing modified starch soap is prepared by reacting 12.0 grams of the zinc polymeric complex with a mixture of 13.7 grams of tallow fatty acid and 14.0 grams of Zn-complex modified starch. To the resulting product 2.0 grams of hydrogen peroxide are added. A specific gravity of 1.277 is measured.

The foregoing examples have been presented in order to illustrate various embodiments of the present invention. It should be understood, however, that the method and product of the present invention can not be limited thereto and modifications within the foregoing examples and description can be made while still falling within the spirit of the present invention. For example, it is possible to employ a mixture of inorganic monomeric or polymeric complexes to achieve a soap product having desired unique characteristics. Likewise, while the previous discussion has been centered around the use of inorganic monomeric and polymeric complexes prepared by a procedure set forth in applicant's co-pending application Ser. No. 631,949, filed on Nov. 17, 1975, the inorganic monomeric and/or polymeric complex need not be produced by such process, as long as the metallic backbone is present and the reactive $NH_2$ and NH groups are present for chemical combination with the fatty acid residues. Furthermore, while certain of the examples set forth above concerned the preparation of soaps from metal-alkali monomeric or polymeric complexes, it should be understood that these examples in no way limit the disclosure herein. Instead it must be realized that the polymeric complexes, as fully described above, can be substituted for the monomeric reactant complexes and vice versa.

What is claimed is:

1. A method of preparing a metal-containing soap which comprises:

mixing at a temperature of at least about 105° F.

(a) an aqueous solution of a water-soluble, multimetal, inorganic, amide group-containing monomeric or polymeric complex prepared by reacting at least one non-alkaline metal, ammonia, and an alkali metal hydroxide, in an aqueous medium, in such manner as to form amide groups; and (b) a fatty acid whereby said fatty acid (b) reacts with said inorganic complex (a) upon mixing, and said soap forms in the reaction system.

2. The method of claim 1 wherein the water content of the reaction system produces said soap as a substantially dry solid.

3. The method of claim 1 wherein said inorganic complex includes at least one alkali metal and at least one non-alkaline metal of Groups I–VIII of the Periodic Table.

4. The method of claim 3 wherein said non-alkaline metal is selected from aluminum, magnesium, silicon, zinc, titanium, zirconium, molybdenum and tungsten.

5. The method of claim 3 wherein said alkali metal is selected from sodium and potassium.

6. The method of claim 1 wherein the reactants (a) and (b) are mixed at a molar ratio of about 1 to about 5 moles of fatty acid per mole of inorganic complex.

7. The method of claim 1 further comprising adding to the reaction system starch which has been modified by reaction with said inorganic complex (a).

8. A metal-containing soap prepared by the method of claim 1.

9. A metal-containing modified starch soap prepared by the method of claim 7.

* * * * *